US006672992B1

(12) United States Patent
Lo et al.

(10) Patent No.: US 6,672,992 B1
(45) Date of Patent: Jan. 6, 2004

(54) EXERCISING DEVICE

(75) Inventors: Kun-Chuan Lo, No. 3, Ching-Cheng 4th St., Taichung City (TW); Hung-Mao Liao, Taichung (TW)

(73) Assignee: Kun-Chuan Lo, Taichung (TW)

( * ) Notice: Subject to any disclaimer, the term of this patent is extended or adjusted under 35 U.S.C. 154(b) by 0 days.

(21) Appl. No.: 10/289,727

(22) Filed: Nov. 7, 2002

(30) Foreign Application Priority Data

Jun. 21, 2002 (TW) ..... 91209382 U

(51) Int. Cl.[7] ..... A63B 69/16; A63B 21/00
(52) U.S. Cl. ..... 482/52; 482/70
(58) Field of Search ..... 482/51–53, 57–65, 482/70, 71

(56) References Cited

U.S. PATENT DOCUMENTS 5,762,588 A * 6/1998 Chen ..... 482/57
5,779,599 A * 7/1998 Chen ..... 482/57
5,833,583 A * 11/1998 Chuang ..... 482/60
6,042,512 A * 3/2000 Eschenbach ..... 482/52
6,090,014 A * 7/2000 Eschenbach ..... 482/52
6,277,056 B1 * 8/2001 McBride et al. ..... 482/57

* cited by examiner

*Primary Examiner*—Stephen R. Crow
(74) *Attorney, Agent, or Firm*—Trop, Pruner & Hu, P.C.

(57) ABSTRACT

An exercising device includes a hand operated member pivoted to a frame and connected to a first coupler, a lever member pivoted to the frame and connected to the hand operated member by a linking bar, and a second coupler member with a front coupling end connected to the lever member and a rear coupling end in friction contact with a motion guiding member which is journalled on first and second crank members. As such, the second coupling member proceeds with a reciprocating movement in a substantially elliptical path which is restrained by the pivot connection between the handle operated member and the lever member.

12 Claims, 9 Drawing Sheets

EXERCISING DEVICE

BACKGROUND OF THE INVENTION

1. Field of the Invention

This invention relates to an exercising device which produces an elliptical foot movement, more particularly to an exercising device in which the elliptical path of the elliptical foot movement may be varied.

2. Description of the Related Art

Referring to FIG. 1, a conventional exercising device with an elliptical foot movement is shown to include a support frame 1, a transmitting assembly 2, a pair of swing members 3, and a pair of treading members 4. The support frame 1 includes a base support 101 for placing on a ground, and front and rear mounting posts 102, 103 mounted on front and rear portions of the base support 101. The transmitting assembly 2 is pivoted on the rear mounting post 103, and has a pair of linking members 201. The swing members 3 have upper ends which are pivoted to the front mounting post 102, and lower ends which are pivoted to front ends of the treading members 4. The treading members 4 have rear ends which are pivoted to the linking members 201, respectively. Two foot pads 401 are mounted on the treading members 4. As such, when the user applies forward and backward forces on the foot pads 401 to swing the lower ends of the swing members 3, the treading members 4 will be brought to proceed with a reciprocating movement along an elliptical path.

However, the size of the elliptical path in the conventional exercising device is unchangeable. Thus, the conventional exercising device cannot suit the requirements of different users.

SUMMARY OF THE INVENTION

The object of the present invention is to provide an exercising device which can generate a variable elliptical foot path to suit the requirements of different users.

According to this invention, the exercising device includes a base support which is adapted to be placed on a ground and which has front and rear portions opposite to each other in a longitudinal direction. A front mounting post extends upwardly from the front portion. A hand operated member is mounted on and is pivotable relative to an upper segment of the front mounting post, and includes handle and lever portions. The lever portion extends downwardly and terminates at a first distal end. A first coupler member includes a first front coupling end which is connected to the first distal end, and a first intermediate portion which extends rearwardly from the first front coupling end and which terminates at a first rear coupling end. A first crank member includes a first crankpin which is pivoted to the first rear coupling end, a first crank arm which is connected to the first crankpin, and a first crankshaft which is pivoted to the first crank arm opposite to the first crankpin. A lever member includes a proximate end which is pivotally mounted relative to an intermediate segment of the front mounting post, and a middle portion which extends from the proximate end and terminating at a second distal end. A linking bar has right and left linking ends which are respectively connected to the first distal end of the lever portion and the middle portion of the lever member. A second coupler member includes a second front coupling end which is connected to the second distal end of the lever member, and a second intermediate portion which extends rearwardly from the second front coupling end and which terminates at a second rear coupling end.

A rear mounting post is disposed on and extends upright from the rear portion. A second crank member includes a second crankshaft which is mounted on and which is rotatable relative to the rear mounting post, a second crank arm which is connected to and which rotates with the second crankshaft, and a second crankpin which is connected to the second crank arm opposite to the second crankshaft and which extends to face toward the first crankshaft.

A motion guiding member is disposed underneath and is in friction contact with the second rear coupling end of the second coupler member, and has right and left ends which are respectively journalled on the second crankpin and the first crankshaft.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
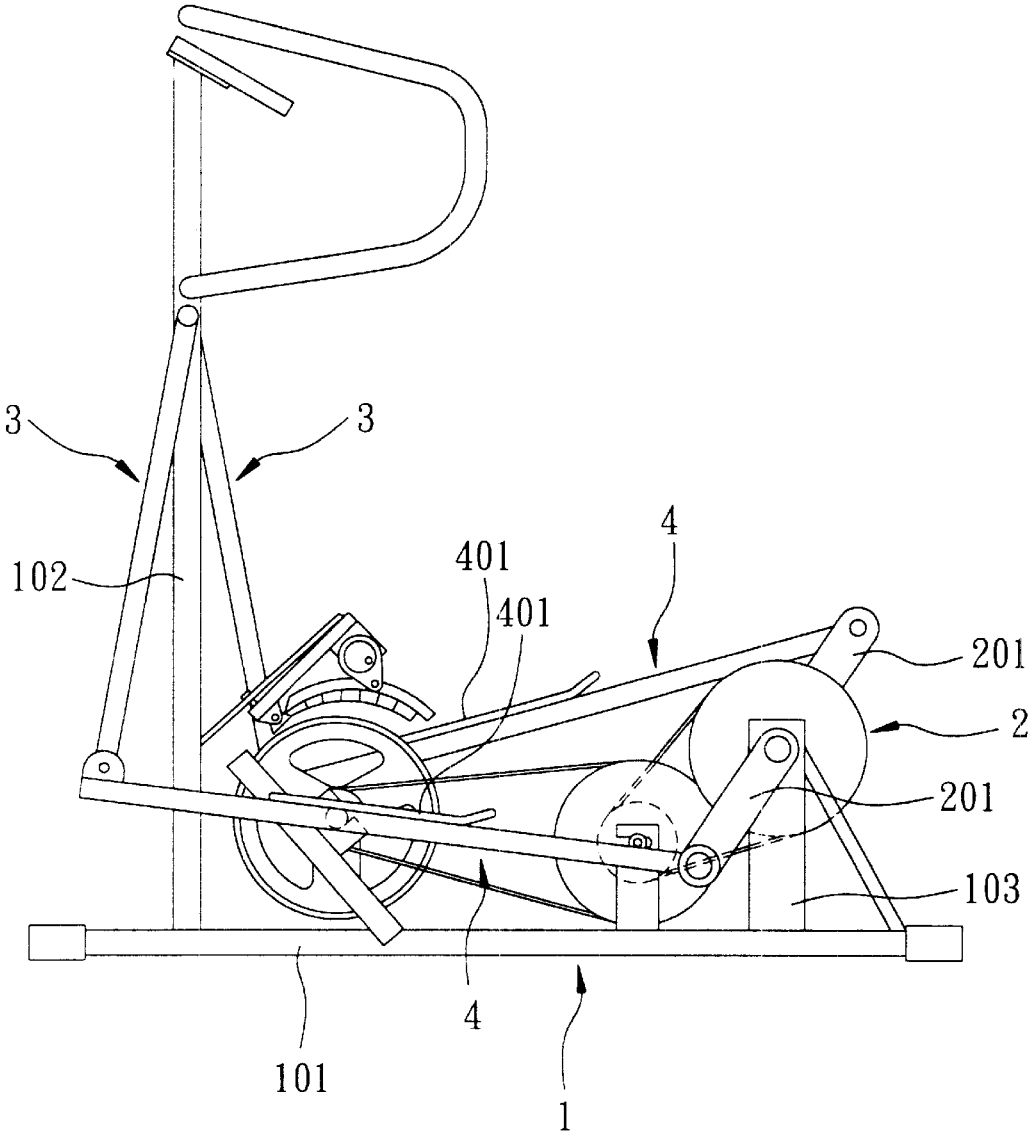
FIG. 1 PRIOR ART
FIG. 1 is a side view of a conventional exercising device.
Figure 2:
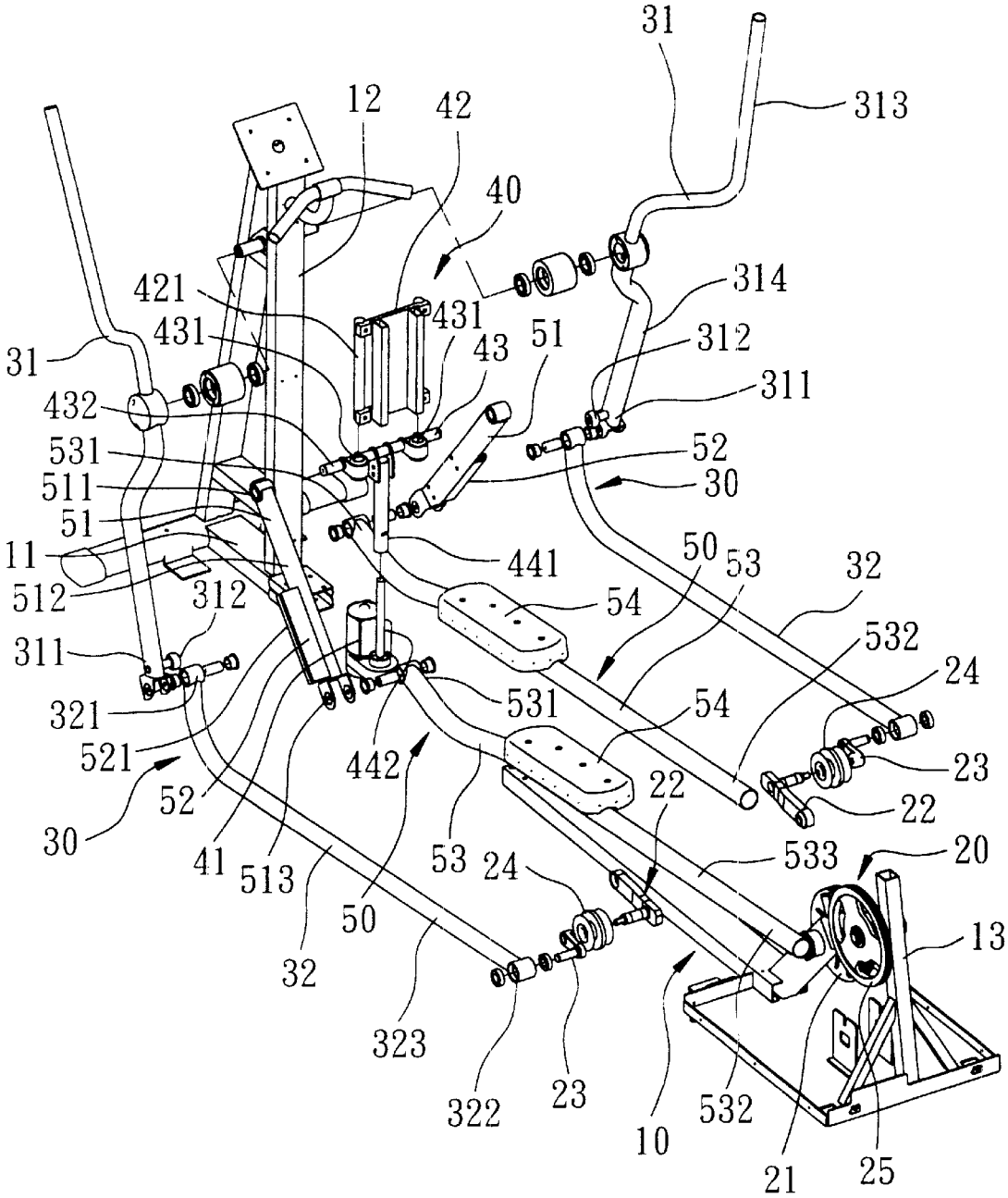
FIG. 2 is an exploded perspective view of a preferred embodiment of an exercising device according to this invention.
Figure 3:
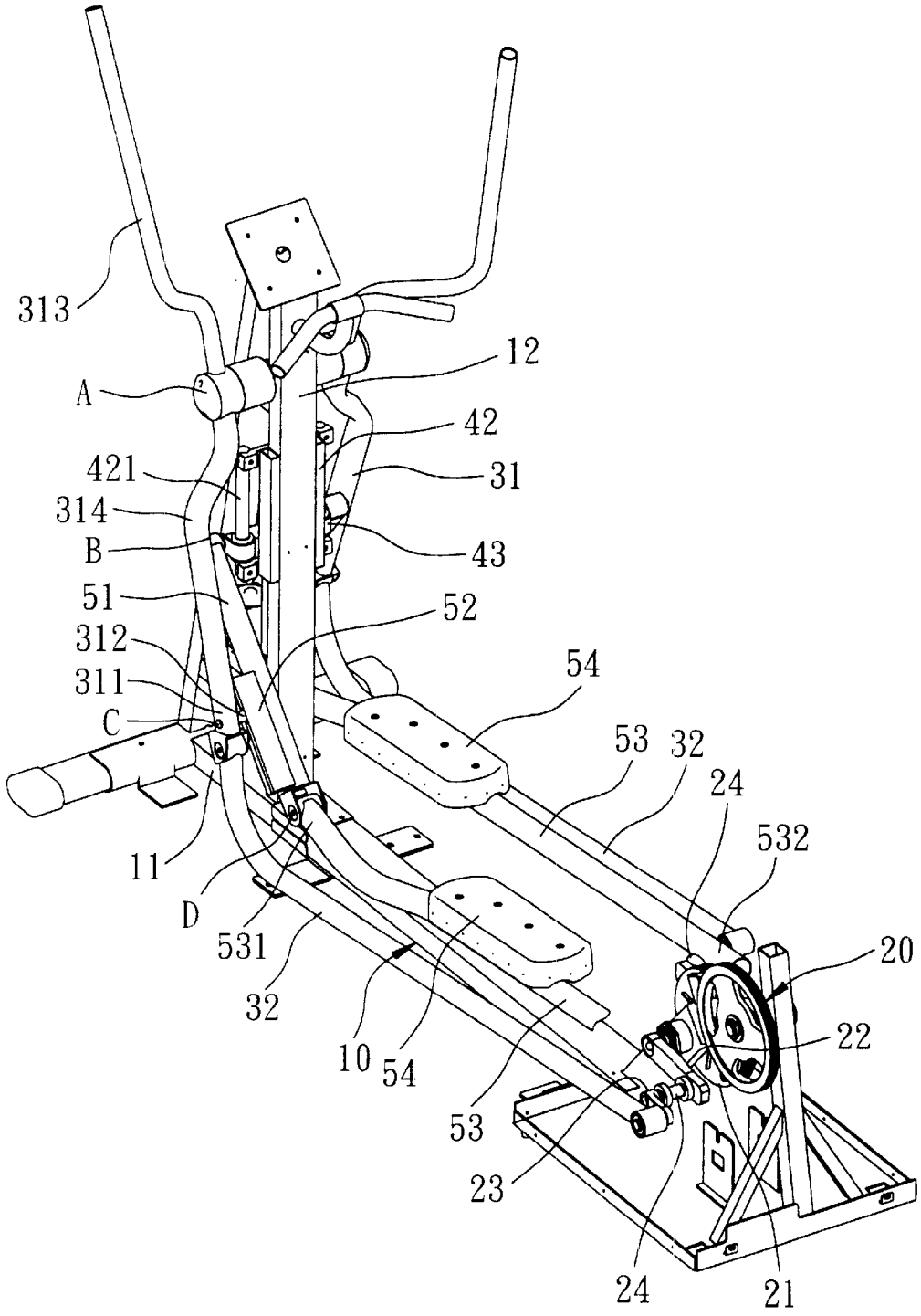
FIG. 3 is a fragmentary perspective view of the preferred embodiment.
Figure 4:
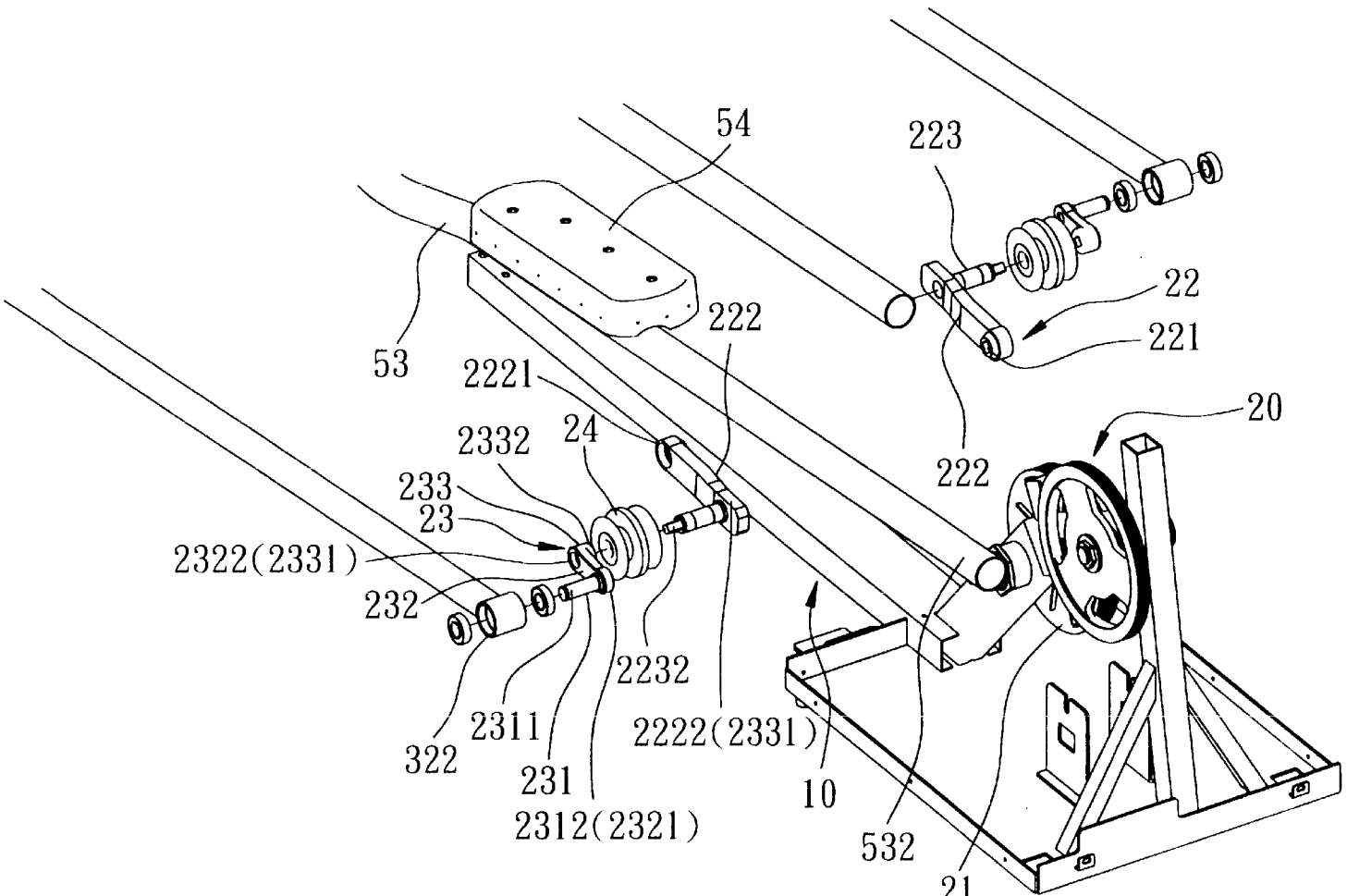
FIG. 4 is an enlarged perspective view of a portion of the preferred embodiment.
Figure 5:
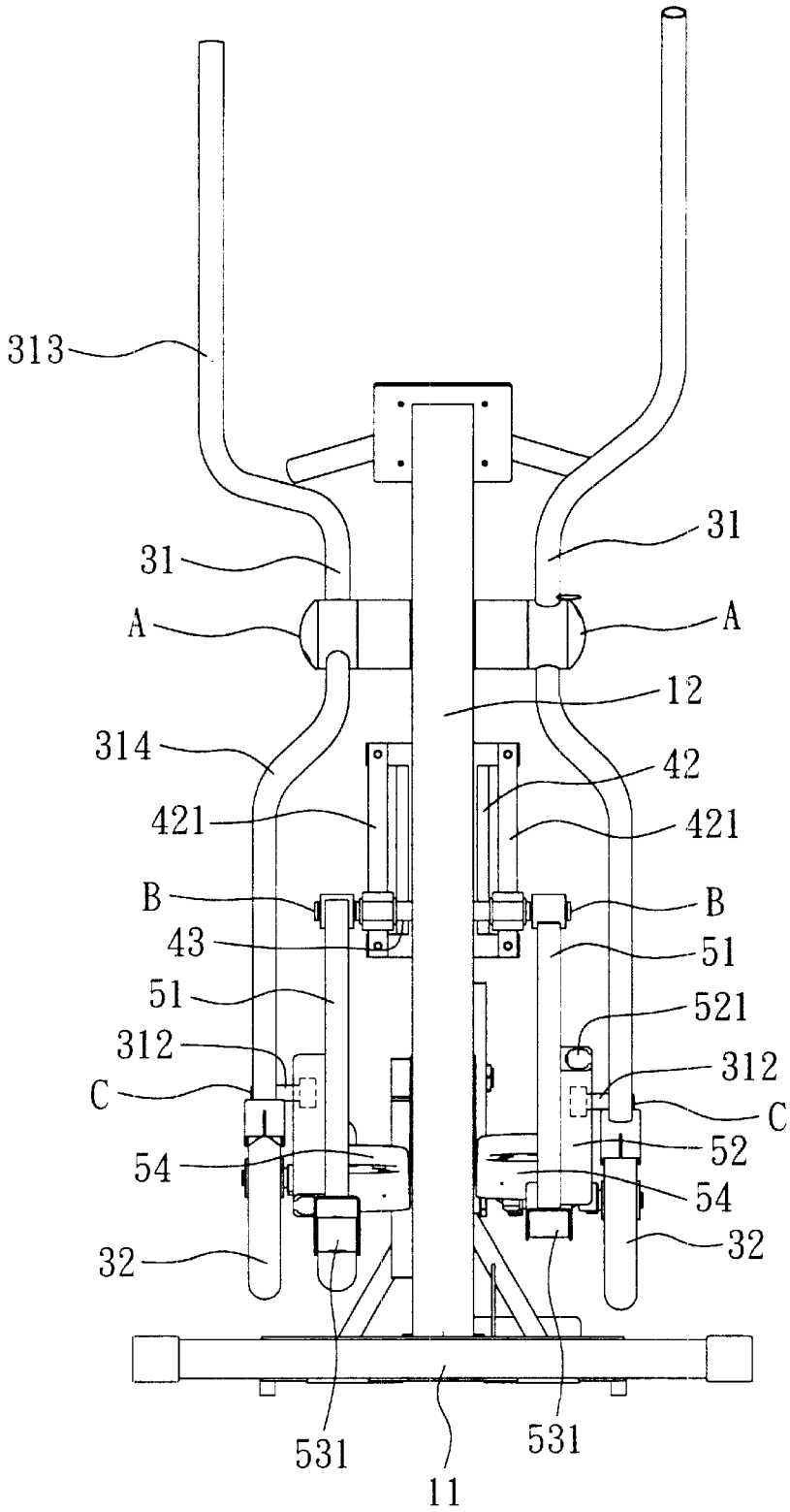
FIG. 5 is a front view of the preferred embodiment.

Referring to FIGS. 2 to 5, the preferred embodiment of the exercising device according to the present invention is shown to comprise a support frame 10, a transmitting mechanism, a pair of swing mechanisms 30, a path adjusting mechanism 40, and a pair of treading mechanisms 50.

The support frame 10 includes a base support 11 which is adapted to be placed on a ground and which has front and rear portions opposite to each other in a longitudinal direction, a front mounting post 12 which extends upwardly from the front portion of the base support 11 and which includes lower and upper segments respectively proximate to and distal from the front portion, and an intermediate segment interposed between the lower and upper segments, and a rear mounting post 13 which is disposed on and which extends upright from the rear portion.

Each of the swing mechanisms 30 includes a hand operated member 31, a first coupler member 32, and a linking bar 312. The hand operated member 31 is mounted on and is pivotable relative to the upper segment of the front mounting post 12 about a first pivoting axis (A), and includes handle and lever portions 313,314 disposed respectively at opposite sides of the first pivoting axis (A). The lever portion 314 extends downwardly and terminates at a first distal end 311. The first coupler member 32 includes a first front coupling end 321 which is connected pivotally to the first distal end 311, and a first intermediate portion 323 which extends rearwardly from the first front coupling end 321 and which terminates at a first rear coupling end 322. The linking bar 312 has a left (right) linking end which is secured to the first distal end 311 of the lever portion 314, and a right (left) linking end which extends towards the base support 11.

The transmitting mechanism 20 includes a pair of first crank members 23, a flywheel 21, a pair of second crank members 22, and a pair of motion guiding members 24.

The first crank member 23 includes a first crankpin 231, a first crank arm 232, and a first crankshaft 233. The first crankpin 231 has a first proximate pin end 2311 which is pivoted to the first rear coupling end 322 of the respective first coupler member 32, and a first distal pin end 2312 which extends from the first proximate pin end 2311 along a second pivoting axis parallel to the first pivoting axis (A). The first crank arm 232 has a first proximate arm end 2321 which is connected to the first distal pin end 2312, and a first distal arm end 2322 which extends from the first proximate arm end 2321 radially relative to the second pivoting axis. The first crankshaft 233 has a first proximate shaft end 2331 which is pivoted to the first distal arm end 2322 about a third pivoting axis parallel to the second pivoting axis, and a first distal shaft end 2332 which extends from the first proximate shaft end 2331 along the third pivoting axis.

The second crank member 22 includes a second crankshaft 221, a second crank arm 222, and a second crankpin 223. The second crankshaft 221 has a second proximate shaft end which is mounted on and which is rotatable relative to the rear mounting post 13 about a fifth pivoting axis parallel to the second pivoting axis, and a second distal shaft end which extends from the second proximate shaft end along the fifth pivoting axis. The second crank arm 222 has a second proximate arm end 2221 which is connected to and which rotates with the second distal shaft of the second crankshaft 221 about the fifth pivoting axis, and a second distal arm end 2222 which extends from the second proximate arm end 2221 radially relative to the fifth pivoting axis. The second crankpin 223 has a second proximate pin end 2231 which is connected to the second distal arm end 2222, and a second distal pin end 2232 which extends from the second proximate pin end 2231 along a sixth pivoting axis parallel to the fifth pivoting axis and which faces towards the first distal shaft end 2332 of the respective first crankshaft 233.

Preferably, the first crankshaft 233 is coaxial with and is formed integrally with the respective second crankpin 223 such that the third pivoting axis coincides with the sixth pivoting axis.

The flywheel 21 is mounted on and rotates with the second crankshafts 221 about the fifth pivoting axis. A resistance generating wheel 25 is coupled to the flywheel 21 in a known manner so as to exert a resisting force to retard rotation of the flywheel 21.

Each of the motion guiding members 24 is a roller which is rotatably sleeved on a corresponding pair of the second distal pin end 2232 and the first distal shaft end 2332.

The path adjusting mechanism 40 includes a motor 41 mounted on the front portion of the base support 11, a guiding seat 42 secured on the intermediate segment of the front mounting post 12, an adjusting mounting member 43, and a threaded bolt 442 which is mounted on the front portion of the base support 11 and which is coupled to and driven by the motor 41 to be rotatable relative to the front portion of the base support 11 about an upright axis. The guiding seat 42 has a pair of uprightly extending guiding rods 421. The adjusting mounting member 43 has an uprightly extending sleeve 441 with an internally threaded surface which engages threadedly the threaded bolt 442, and a pin portion 432 which extends along a fourth pivoting axis (B) parallel to the first pivoting axis (A) and which has two holes 431 for passage of the guiding rods 421. Thus, rotation of the threaded bolt 442 results in linear movement of the adjusting mounting member 43 along the upright axis.

Each of the treading mechanisms 50 includes a lever member 51 and a second coupler member 53.

The lever member 51 includes a proximate end 511 which is journalled on the pin portion 432 of the adjusting mounting member 43, and a middle portion 512 which extends from the proximate end 511 and which terminates at a second distal end 513. A limiting seat 52 is secured on the middle portion 512 adjacent to the second distal end 513, and has an elongate groove 521 which extends in a lengthwise direction. The right(left) linking end of the respective linking bar 312 is connected adjustably to the limiting seat 52. Particularly, the right (left) linking end of the respective linking bar 312 engages slidably the elongate groove 521 so as to vary the pivot position (C) of the linking bar 312 relative to the second distal end 513. When the lever portion 314 is moved by the handle portion 313 to swing about the first pivoting axis (A), the middle portion 512 of the lever member 51 will driven by the linking bar 312 to swing about the fourth pivoting axis (B).

The second coupler member 53 includes a second front coupling end 531 which is connected pivotally to the second distal end 513 of the lever member 51 about a seventh pivoting axis (D), and a second intermediate portion 533 which extends rearwardly from the second front coupling end 531 and which terminates at a second rear coupling end 532. Thus, when the middle portion 512 of the lever member 51 swings, the second intermediate portion 533 will be brought to proceed with a reciprocating movement in the longitudinal direction. In addition, a foot pad 54 is mounted on the second intermediate portion 533.

The second rear coupling end 532 of the second coupler member 53 is disposed on and in friction contact with the respective motion guiding member 24. As such, while the second intermediate portion 533 of the second coupler member 53 proceeds with the reciprocating movement, and while the motion guiding member 24 is dragged by the reciprocating movement through the friction contact to move the second crank arm 222 together with the second crankshaft 221 to rotate about the fifth pivoting axis, the first distal shaft end 2332 of the first crankshaft 233 remains supported by the motion guiding member 24 through journaling of the first distal shaft end 2332.

Figure 6:
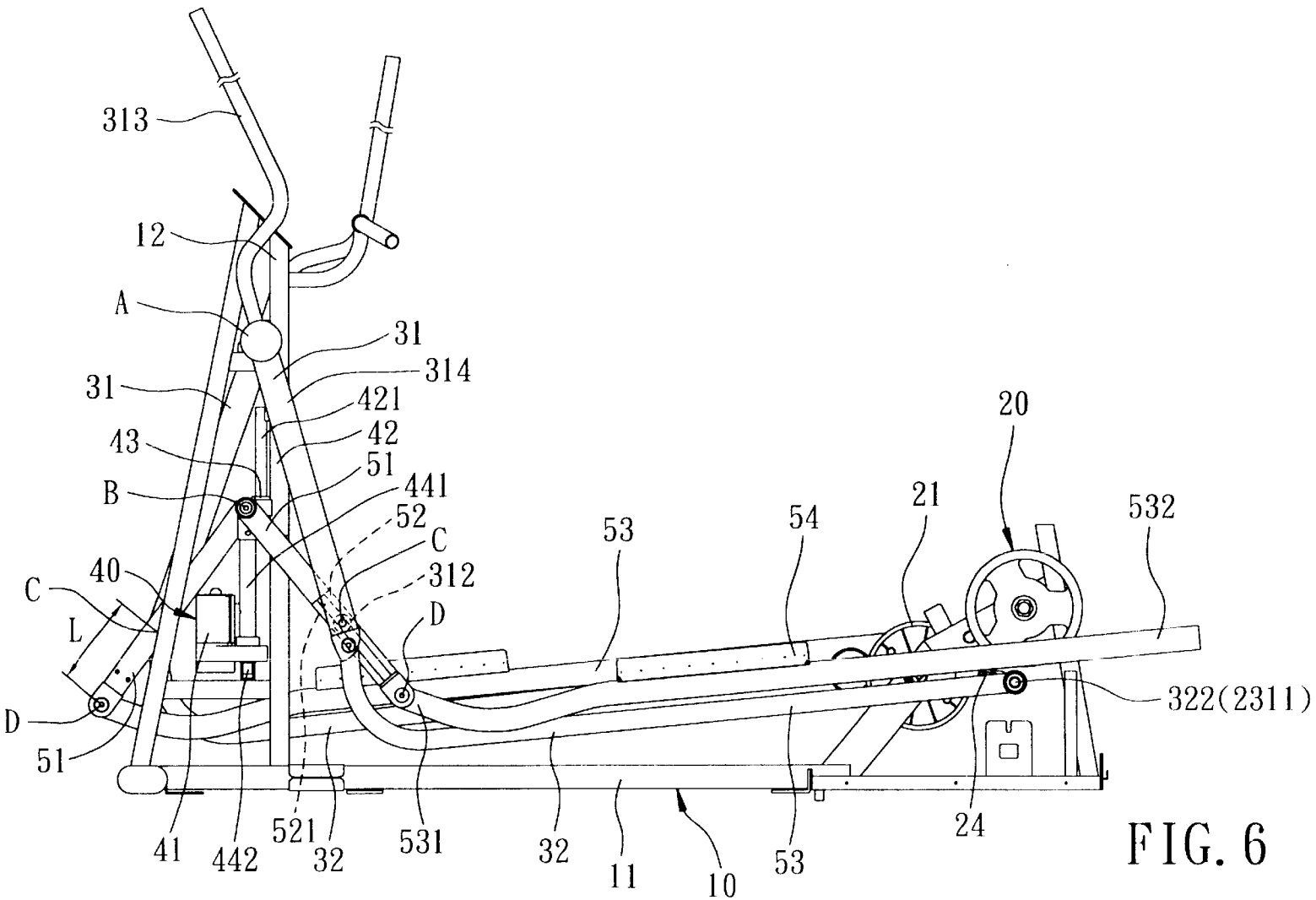
FIG. 6 is a side view of the preferred embodiment.

With reference to FIG. 6, when the user grasps the hand portions 313 and applies forward and backward forces on the foot pads 54, the lever portions 314 are swung about the first pivoting axis (A) to swing the first coupler members 32. In addition, the middle portions 512 of the lever members 51 can swing about the fourth pivoting axis (B) so as to drive the second coupler members 53 to proceed with the reciprocating movement in a substantially elliptical path. By virtue of the pivot connection of the linking bars 312 to the middle portions 512 of the lever members 51, the elliptical path is restrained. In particular, the larger the distance between the pivot position (C) of the linking bars 312 and the seventh pivoting axis (D), the larger will be the elliptical path.

Figure 7:
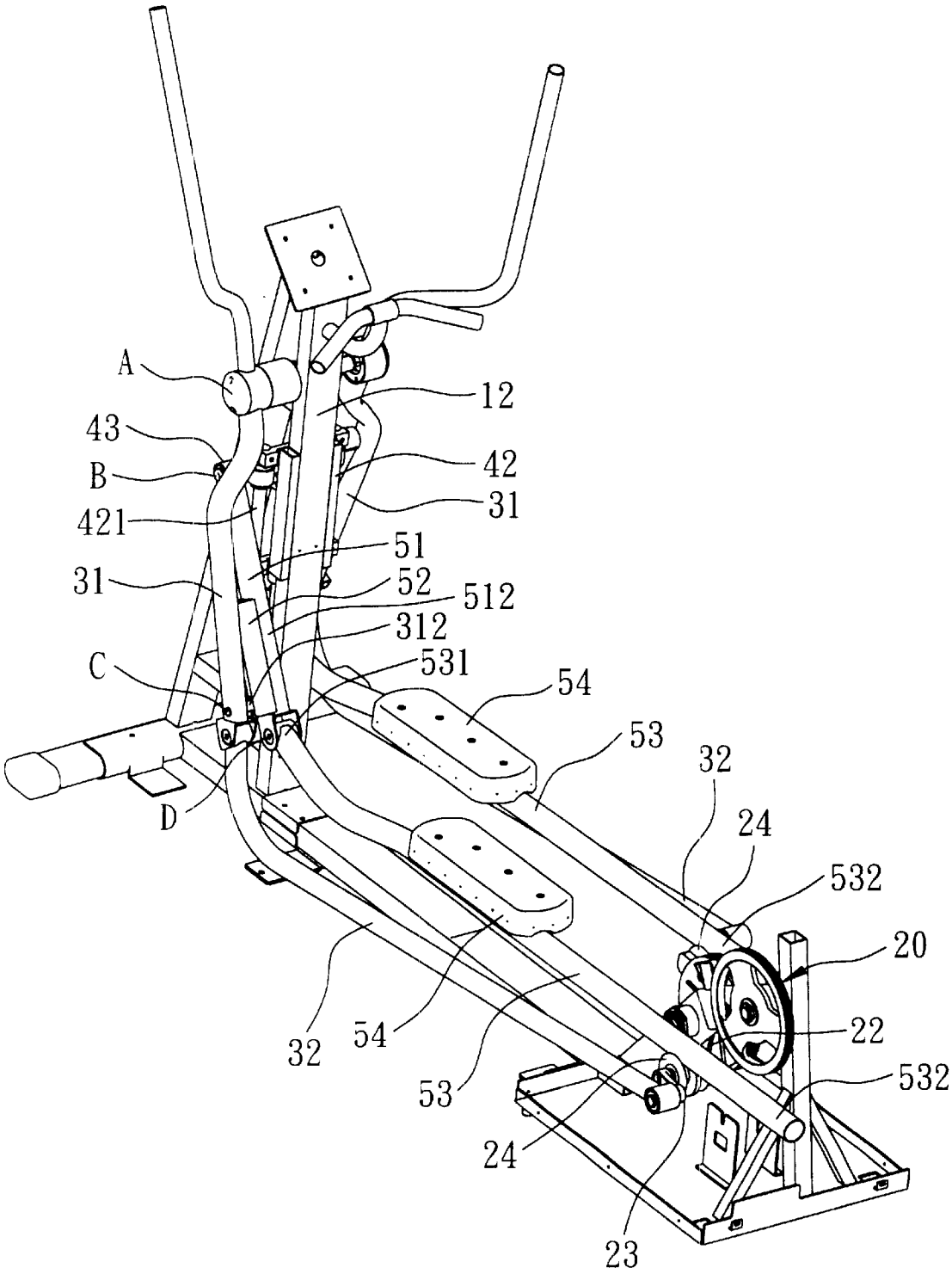
FIG. 7 is a perspective view showing the preferred embodiment when configured to generate a smaller elliptical path of foot movement.
Figure 8:
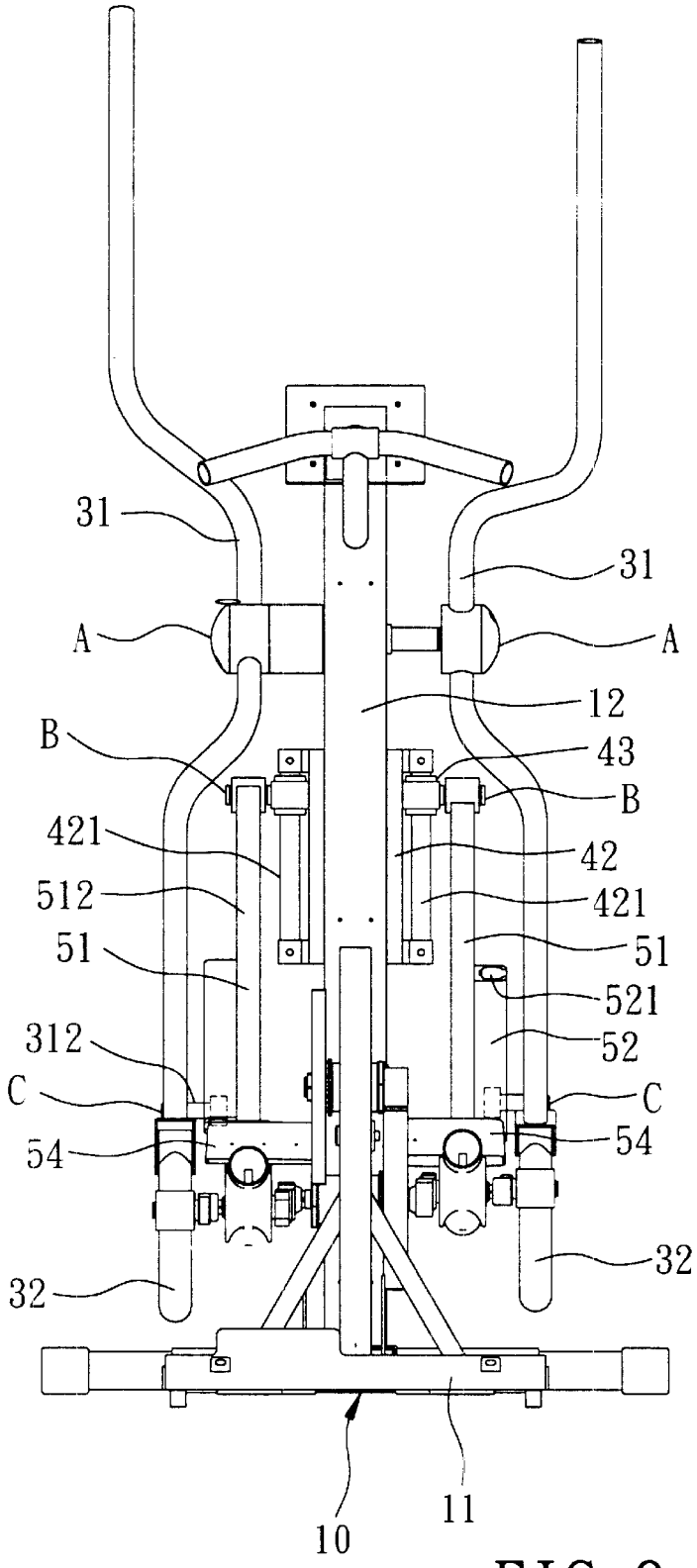
FIG. 8 is a front view of the preferred embodiment in the state shown in FIG. 7.
Figure 9:
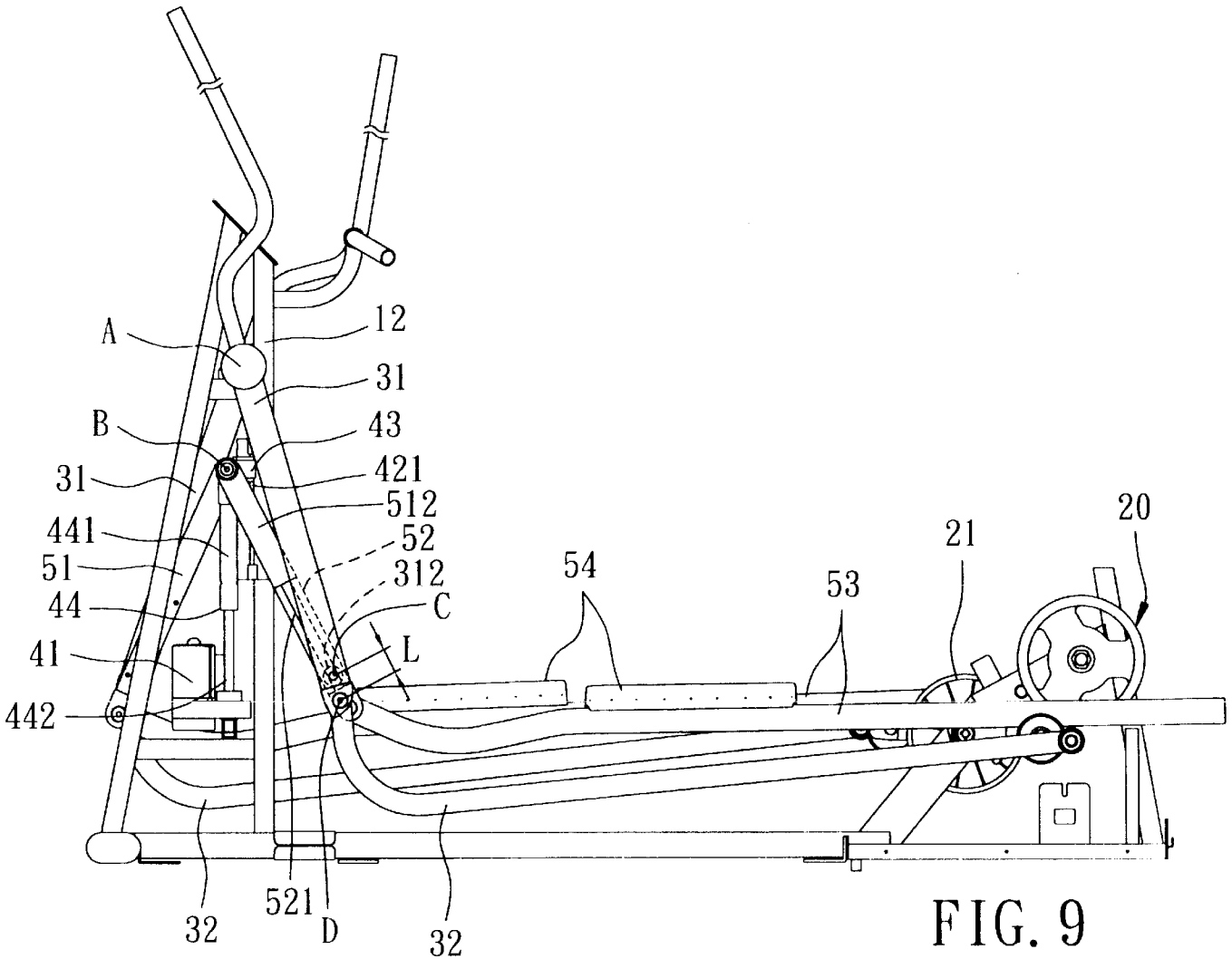
FIG. 9 is a side view of the preferred embodiment in the state shown in FIG. 7.

Referring to FIGS. 7 to 9, when it is desired to reduce the elliptical path, that is, to decrease the distance (L), the user can actuate the motor 41 by means of an operating panel mounted on the upper segment of the front mounting post to rotate the threaded bolt 442 so as to raise the adjusting mounting member 44. At this time, the fourth pivoting axis (B) is lifted, and the middle portions 512 of the lever members 51 swing downwardly about the fourth pivoting axis (B) so that the pivot position (C) of the linking bars 312 is close to the seventh pivoting axis (D).

Moreover, by virtue of the path adjusting mechanism 40, the fourth pivoting axis (B) and the pivot position (C) can be varied simultaneously so that the elliptical path of the foot pads 54 can be adjusted conveniently during exercising.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. An exercising device comprising:

a base support adapted to be placed on a ground, and having front and rear portions opposite to each other in a longitudinal direction;

a front mounting post disposed to extend upwardly from said front portion, and including lower and upper segments respectively proximate to and distal from said front portion, and an intermediate segment interposed between said lower and upper segments;

a hand operated member mounted on and pivotable relative to said upper segment about a first pivoting axis, and including handle and lever portions disposed respectively at opposite sides of the first pivoting axis, said lever portion extending downwardly and terminating at a first distal end;

a first coupler member including a first front coupling end which is connected to said first distal end, and a first intermediate portion which extends rearwardly from said first front coupling end and which terminates at a first rear coupling end;

a first crank member including a first crankpin having a first proximate pin end which is pivoted to said first rear coupling end, and a first distal pin end which extends from said first proximate pin end along a second pivoting axis parallel to the first pivoting axis, a first crank arm having a first proximate arm end which is connected to said first distal pin end, and a first distal arm end which extends from said first proximate arm end radially relative to the second pivoting axis, and a first crankshaft having a first proximate shaft end which is pivoted to said first distal arm end about a third pivoting axis parallel to the second pivoting axis, and a first distal shaft end which extends from said first proximate shaft end along the third pivoting axis;

a lever member including a proximate end which is pivotally mounted relative to said intermediate segment about a fourth pivoting axis parallel to the first pivoting axis, and a middle portion which extends from said proximate end and terminating at a second distal end;

a linking bar having right and left linking ends which are respectively connected to said first distal end of said lever portion and said middle portion of said lever member, such that when said lever portion is moved by said handle portion to swing about the first pivoting axis, said middle portion will be driven by said linking bar to swing about the fourth pivoting axis;

a second coupler member including a second front coupling end which is connected to said second distal end of said lever member, and a second intermediate portion which extends rearwardly from said second front coupling end and which terminates at a second rear coupling end, said second intermediate portion proceeding with a reciprocating movement in the longitudinal direction when said middle portion of said lever member swings;

a rear mounting post disposed on and extending from said rear portion uprightly;

a second crank member including a second crankshaft having a second proximate shaft end which is mounted on and which is rotatable relative to said rear mounting post about a fifth pivoting axis parallel to the second pivoting axis, and a second distal shaft end extending from said second proximate shaft end along the fifth pivoting axis, a second crank arm having a second proximate arm end which is connected to and which rotates with said second distal shaft end about the fifth pivoting axis, and a second distal arm end which extends from said second proximate arm end radially relative to the fifth pivoting axis, and a second crankpin having a second proximate pin end which is connected to said second distal arm end, and a second distal pin end which extends from said second proximate pin end along a sixth pivoting axis parallel to the fifth pivoting axis and which faces towards said first distal shaft end; and a motion guiding member disposed underneath and in friction contact with said second rear coupling end of said second coupler member, and having right and left ends which are respectively journalled on said second distal pin end and said first distal shaft end, such that while said second intermediate portion of said second coupler member proceeds with the reciprocating movement, and while said motion guiding member is dragged by the reciprocating movement through the friction contact to move said second crank arm together with said second crankshaft to rotate about the fifth pivoting axis, said first distal shaft end remains to be supported by said motion guiding member through journaling of said first distal shaft end.

2. The exercising device according to claim 1, further comprising a flywheel which is mounted on and which rotates with said second crankshaft about the fifth pivoting axis, and a resistance generating member which is coupled to said flywheel so as to exert a resisting force to retard rotation of said flywheel.

3. The exercising device according to claim 1, wherein said right linking end of said linking bar is adjustably connected to said middle portion of said lever member.

4. The exercising device according to claim 3, wherein said right linking end is adjustably connected to said middle portion proximate to said second distal end of said middle portion.

5. The exercising device according to claim 4, wherein said left linking end is secured to said first distal end of said lever portion, said middle portion of said lever member being formed with an elongate groove which extends in a lengthwise direction such that said right linking end engages slidably said groove so as to adjust position of said first distal end relative to said second distal end.

6. The exercising device according to claim 5, wherein said proximate end of said lever member is disposed to be movable uprightly relative to said intermediate segment of said front mounting post such that movement of said proximate end results in sliding movement of said right linking end in said groove.

7. The exercising device according to claim 6, further comprising:

a threaded bolt mounted on and rotatable relative to said front portion of said base support about an upright axis; and an adjusting mounting member having an internally threaded surface which extends along the upright axis and which engages threadedly said threaded bolt, and a pin portion which extends along the fourth pivoting axis, said proximate end of said lever member being journalled on said pin portion, said pin portion being disposed to be movable along and not rotatable about the upright axis such that rotation of said threaded bolt results in linear movement of said pin portion and said proximate end of said lever member along the upright axis.

8. The exercising device according to claim 7, further comprising a motor coupled to and driving rotation of said threaded bolt.

9. The exercising device according to claim 1, further comprising a foot pad which is mounted on said second intermediate portion of said second coupler member.

10. The exercising device of claim 1, wherein said first crankshaft is coaxial with and is formed integrally with said second crankpin such that the third pivoting axis coincides with the sixth pivoting axis.

11. The exercising device of claim 10, wherein said motion guiding member is a roller rotatably sleeved on said second distal pin end and said first distal shaft end.

12. An exercising device comprising:

a base support adapted to be placed on a ground, and having front and rear portions opposite to each other in a longitudinal direction;

a front mounting post disposed to extend upwardly from said front portion, and including lower and upper segments respectively proximate to and distal from said front portion, and an intermediate segment interposed between said lower and upper segments;

a hand operated member mounted on and pivotable relative to said upper segment about a first pivoting axis, and including handle and lever portions disposed respectively at opposite sides of the first pivoting axis, said lever portion extending downwardly and terminating at a first distal end;

a first coupler member including a first front coupling end which is connected to said first distal end, and a first intermediate portion which extends rearwardly from said first front coupling end and which terminates at a first rear coupling end;

a lever member including a proximate end which is pivotally mounted relative to said intermediate segment about a fourth pivoting axis parallel to the first pivoting axis, and a middle portion which extends from said proximate end and terminating at a second distal end;

a linking bar having right and left linking ends which are respectively connected to said first distal end of said lever portion and said middle portion of said lever member, such that when said lever portion is moved by said handle portion to swing about the first pivoting axis, said middle portion will be driven by said linking bar to swing about the fourth pivoting axis;

a second coupler member including a second front coupling end which is connected to said second distal end of said lever member, and a second intermediate portion which extends rearwardly from said second front coupling end and which terminates at a second rear coupling end, said second intermediate portion proceeding with a reciprocating movement in the longitudinal direction when said middle portion of said lever member swings;

a rear mounting post disposed on and extending from said rear portion uprightly;

a crank assembly including a crankpin which is pivoted to said first rear coupling end, a crankshaft which is mounted on and which is rotatable relative to said rear mounting post about a pivoting axis parallel to the first pivoting axis, and a crank arm assembly which is disposed between said crankpin and said crankshaft; and a motion guiding member disposed underneath and in friction contact with said second rear coupling end of said second coupler member, and journalled on said crank arm assembly, such that while said second intermediate portion of said second coupler member proceeds with the reciprocating movement, and while said motion guiding member is dragged by the reciprocating movement through the friction contact to move said crank arm assembly together with said crankshaft to rotate about the pivoting axis, said crank arm assembly remains to be supported by said motion guiding member through journaling of said crank arm assembly.

* * * * *